US008205760B2

(12) United States Patent
Chang

(10) Patent No.: US 8,205,760 B2
(45) Date of Patent: Jun. 26, 2012

(54) CURVED CURTAIN ROD

(75) Inventor: Jim Chang, San Leandro, CA (US)

(73) Assignee: Gatco, Inc., San Leandro, CA (US)

( * ) Notice: Subject to any disclaimer, the term of this patent is extended or adjusted under 35 U.S.C. 154(b) by 135 days.

(21) Appl. No.: 12/893,318

(22) Filed: Sep. 29, 2010

(65) Prior Publication Data

US 2012/0074085 A1 Mar. 29, 2012

(51) Int. Cl.
*A47H 1/08* (2006.01)

(52) U.S. Cl. ..... 211/105.3; 4/610

(58) Field of Classification Search .... 211/105.1–105.4, 211/123, 182, 183; 4/558, 610, 557, 607, 4/608; 248/251, 261, 264; 16/93 D, 95 D, 16/96 D; 160/330, 350; D8/363, 376
See application file for complete search history.

(56) References Cited

U.S. PATENT DOCUMENTS

| | | | | |
|---|---|---|---|---|
| 3,204,898 | A * | 9/1965 | Manning | 248/516 |
| 5,056,753 | A * | 10/1991 | Lunau et al. | 248/542 |
| 5,281,063 | A * | 1/1994 | Austin, III | 410/151 |
| 5,538,364 | A * | 7/1996 | Huntsman | 405/288 |
| 6,216,287 | B1 | 4/2001 | Wise | |
| 6,694,543 | B2 * | 2/2004 | Moore | 4/610 |
| D542,897 | S | 5/2007 | Harwanko | |
| D552,455 | S * | 10/2007 | Moore | D8/363 |
| 7,926,127 | B2 * | 4/2011 | Barrese | 4/610 |
| 7,958,577 | B2 * | 6/2011 | Chang | 4/610 |
| 7,987,534 | B2 * | 8/2011 | Lin | 4/608 |
| 8,069,507 | B2 * | 12/2011 | Didehvar et al. | 4/610 |
| 8,069,508 | B2 * | 12/2011 | O'Connell | 4/610 |
| 8,146,182 | B2 * | 4/2012 | Bauer | 4/558 |
| 2003/0217410 | A1 * | 11/2003 | Moore | 4/610 |
| 2005/0268394 | A1 * | 12/2005 | Monk et al. | 4/558 |

OTHER PUBLICATIONS

Zenith Products Corp., "Installation Instructions—35601SS Curved Rod (Chrome)", Mar. 7, 2006, 2 pages of 10

* cited by examiner

*Primary Examiner* — Jennifer E. Novosad
(74) *Attorney, Agent, or Firm* — Muncy, Geissler, Olds & Lowe, PLLC

(57) ABSTRACT

A curved curtain rod formed by a curved telescopic rod and two fixing bases is revealed. The curved telescopic rod is formed by two curved tubes sleeved with each other while each end of the curved telescopic rod is connected to each fixing base respectively. The fixing base includes a pivotal base having a hollow cylinder mounted with a buffer part therein, a pivotal part whose one end is moveable and connected to the buffer part while the other end is a projecting rod connected to the telescopic rod, and a cover with a central opening covered around the pivotal base. One end of the pivotal part is limited in an inner side of the central opening while the projecting rod passes through the central opening to the outer side, moves and pivots so as to adjust the angle between the telescopic rod and the fixing base.

3 Claims, 4 Drawing Sheets

CURVED CURTAIN ROD

BACKGROUND OF THE INVENTION

The present invention relates to a curtain rod, especially to a curved curtain rod that is formed by a curved telescopic rod and two fixing bases for adjusting connection angles and is easy to be mounted on two parallel wall surfaces or two wall surfaces with an angle therebetween.

In general, a support device for curtains includes two fixing bases respectively arranged on each of two wall surfaces. Each of two ends of a curtain rod is assembled with a fixing base so that a plurality of rings on a curtain is mounted on the curtain rod and moving therearound so as to define a space used as a shower room or a dressing room. There is a plurality of different designs of conventional curtain rods such as shower curtain rods. Refer to U.S. Pat. No. 6,216,287, a one-piece curtain rod is revealed. The length of this curtain rod is unable to be adjusted. Moreover, the two ends of the curtain rod are respectively connected to a fixing base and the angle between the curtain rod and the fixing base is unable to be adjusted according to the requirements of the occasions. Refer to U.S. Pat. No. D542,897, a curved shower curtain rod whose length is adjustable is disclosed. However, a connection part between the shower curtain rod and the fixing base is exposed so that the connection part is easy to get stained or get rusted when exposed to moisture. This affects the appearance. Refer to a product of ZENITH PRODUCTS CORP. whose model number is 35601SS, a curved shower curtain rod with adjustable length is revealed. Each of two ends of the curved shower curtain rod is connected to a curved tube for assembling with a fixing base horizontally. Thus the angle between the curved tube and the fixing base is limited and fixed. This has negative effect on assembling. When there is an angle (such as 90 degrees) between the two wall surfaces, the wall surfaces are not parallel to each other and this product is unable to be used.

SUMMARY OF THE INVENTION

It is a primary object of the present invention to provide a curved curtain rod with beautiful appearance and easy to be assembled and mounted.

In order to achieve the above object, the curved curtain rod consists of a curved telescopic rod and two fixing bases for adjustment of connection angles. Two ends of the curved telescopic rod are connected to the two fixing bases respectively. The length of the curved telescopic rod between the two fixing bases can be adjusted and changed. The two fixing bases are respectively mounted on each of two wall surfaces that are parallel to each other or with an angel therebetween. The angle between each of two ends of the telescopic rod and each of the two fixing bases are adjustable according to the angle between the two wall surfaces.

DETAILED DESCRIPTION OF THE PREFERRED EMBODIMENT

Figure 1:
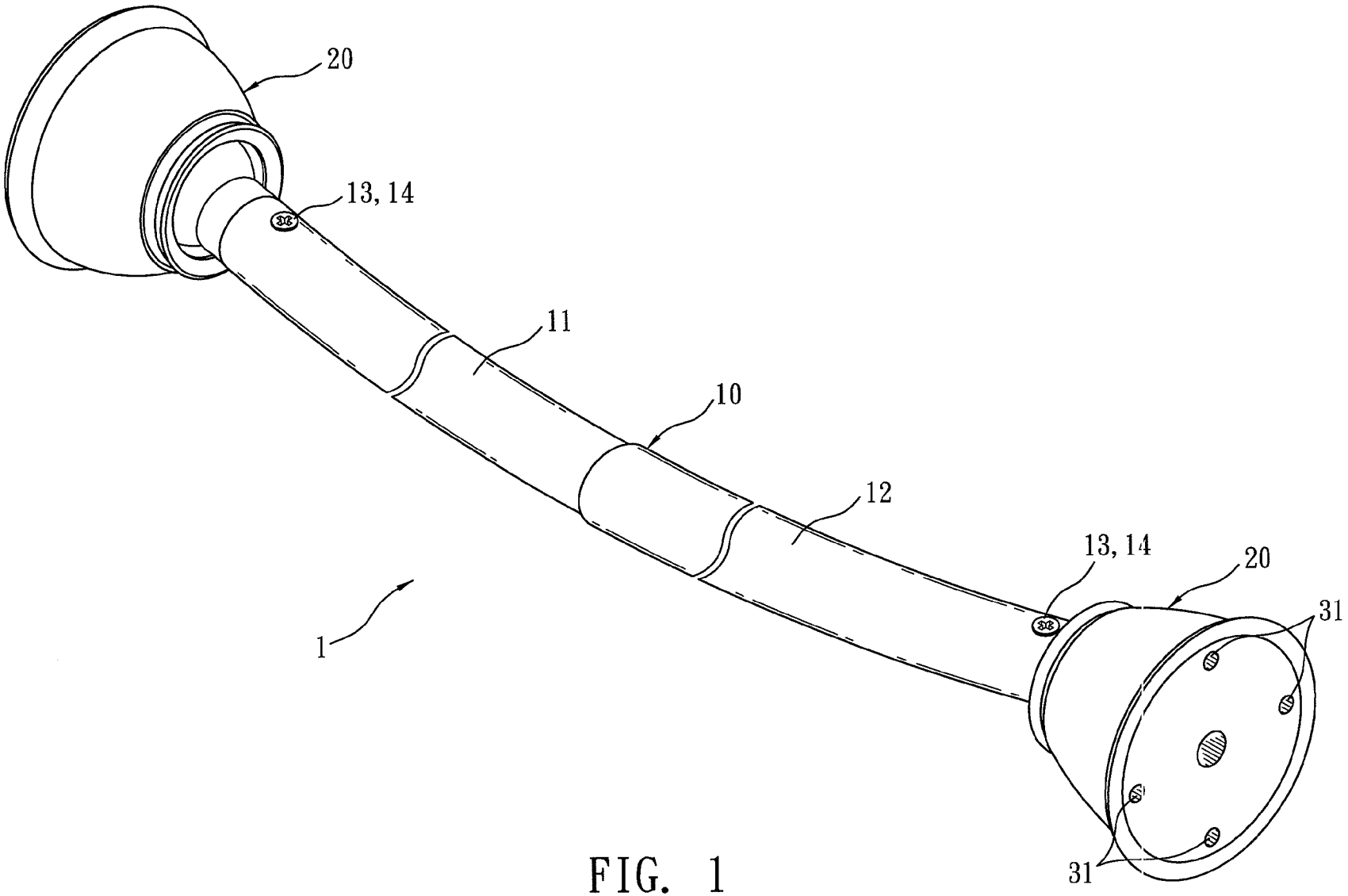
FIG. 1 is a perspective view of an embodiment according to the present invention.
Figure 2:
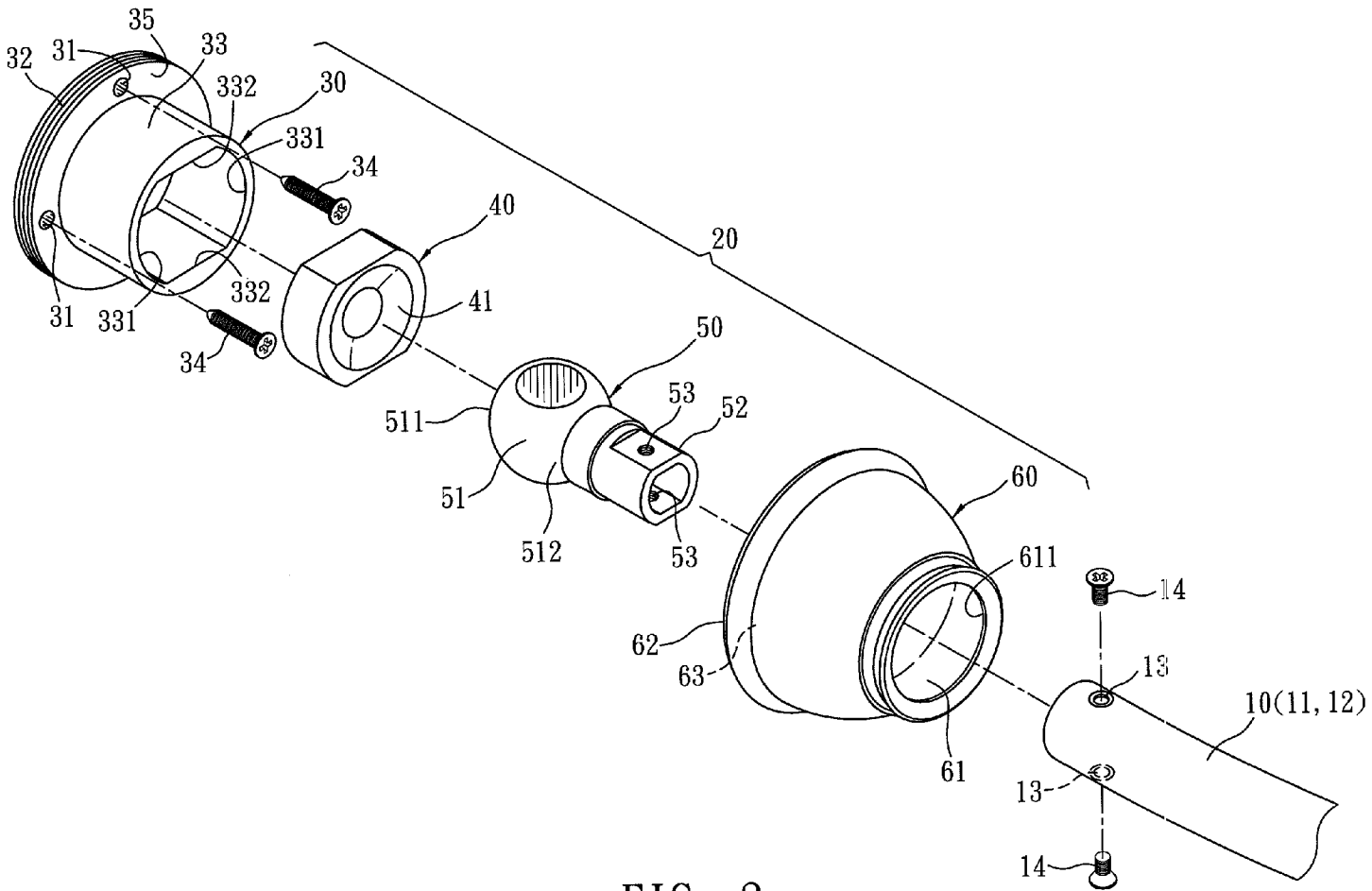
FIG. 2 is a partial explosive view of the embodiment in FIG. 1.
Figure 3:
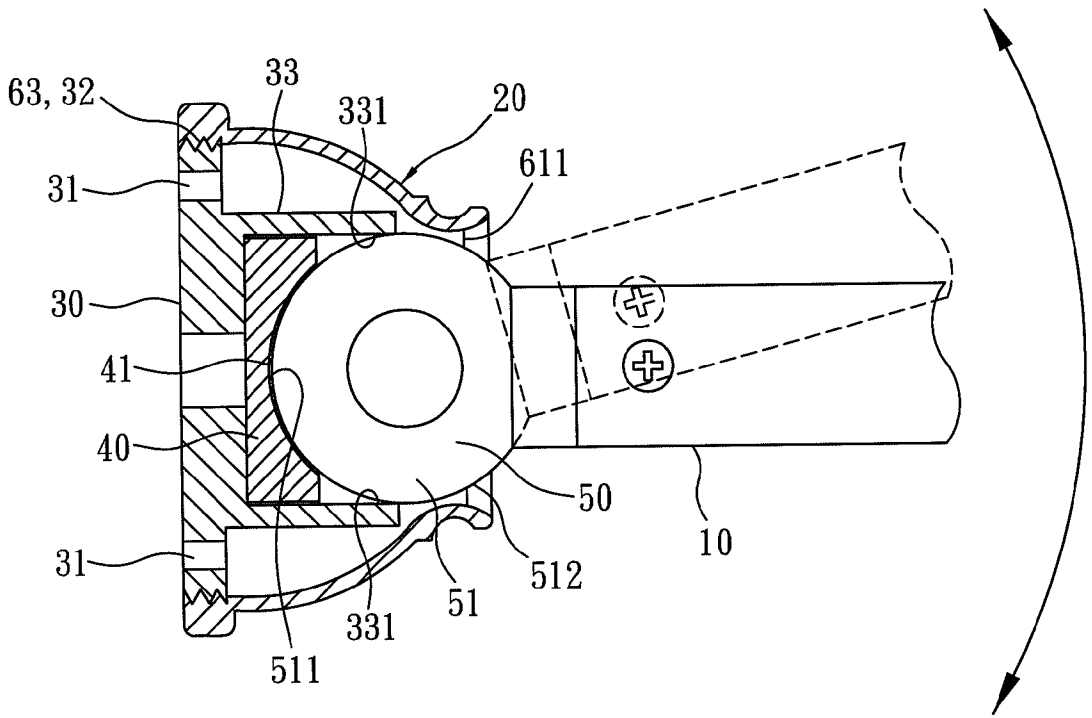
FIG. 3 is a schematic cross sectional view showing pivoting of an embodiment according to the present invention.

Refer from FIG. 1 to FIG. 3, a curved curtain rod 1 according to the present invention consists of a curved telescopic rod 10 and two fixing bases 20. The curved telescopic rod 10 is composed of a curved inner tube 11 and a curved outer tube 12, sleeved with each other while two ends of the curved telescopic rod 10 are connected to the two fixing bases 20 respectively. A radial insertion hole 13 is disposed near each of two ends of the curved telescopic rod 10 so that the curved telescopic rod 10 is fastened and fixed on the fixing base 20 by a fastener 14 such as a screw. Moreover, the curved telescopic rod 10 is adjustable and is adjusted to a proper length that fits preset positions of the two fixing base 20.

As shown in FIG. 2, the fixing base 20 includes a pivotal base 30, a buffer part 40, a pivotal part 50 and a cover 60. The pivotal base 30 is formed by a hollow cylinder 33 and a bottom flange 35. The bottom flange 35 is arranged with a plurality of through holes 31 so as to be mounted on a wall surface by screws. An outer surface of the bottom flange 35 is disposed with an outer thread 32. The hollow cylinder 33 projects axially from the bottom flange and its left and right inner surfaces are symmetrical curved surfaces 331 while top and bottom inner surfaces are symmetrical planes 332. The buffer part 40 is mounted and located in the hollow cylinder 33 of the pivotal base 30 with certain fitness. That means the buffer part 40 is mounted and located among the left and right curved surfaces 331 and the top and bottom planes 332. The buffer part 40 is arranged with a spherical groove 41 on an outer side and the spherical groove 41 is corresponding to the pivotal part 50 for reducing noises induced by impact or friction in use. One end (inner end) of the pivotal part 50 is a spherical surface 51 whose top side and bottom side surfaces are parallel planes, corresponding to the top and bottom planes 332 of the hollow cylinder 33. Thus when part of the spherical surface 51 of the pivotal part 50 is mounted into the hollow cylinder 33, as shown in FIG. 3, part of the spherical surface 51 contacts the spherical groove 41 of the buffer part 40. The planes on the top and bottom sides of the spherical surface 51 are restricted by the top and bottom planes 332 of the hollow cylinder 33 so that the pivotal part 50 pivots horizontally as an arrow indicated in FIG. 3, but not vertically. The other end (outer end) of the pivotal part 50 is a projecting rod 52 that is sleeved with and connected to the telescopic rod 10. The projecting rod 52 is mounted with at least one radial hole 53. The fastener 14 passes through the insertion hole 13 of the telescopic rod 10 to be fastened on the radial hole 53. The cover 60 is designed into a bell-shaped cover around the pivotal base 30 and having a central opening 61 whose inner surface is a circularly curved surface 611. The inner diameter of the central opening 61 is larger than the outer diameter of the projecting rod 52 of the pivotal part 50 but is smaller than the outer diameter of the spherical surface 51. Thus the projecting rod 52 passes through the central opening 61 to the outer side of the central opening 61, moves and pivots horizontally. The inner surface on a bottom 62 of the cover 60 is disposed with an inner thread 63 corresponding to and threaded with the outer thread 32 of the pivotal base 30 so that the cover 60 can be fastened and fixed around the pivotal base 30. Furthermore, the pivotal part 50 is limited in the hollow cylinder 33 of the pivotal base 30, and is able to pivot horizontally, as shown in FIG. 3. By the curved design, the friction between the circularly curved surface 611 and the spherical surface 51 of the pivotal part 50 is reduced.

While assembling, the pivotal base 30 of each fixing base 20 is fixed to a preset wall surface at the same height above the ground by a screw 34 passing through the through hole 31, with the two symmetrical planes 332 in the hollow cylinder 33 on top and bottom positions thereof. Then the two ends of the telescopic rod 10 are fastened and connected to the two pivotal parts 50 respectively by the fastener 14 passing through the insertion hole 13 and the hole 53. The two covers 60 are firstly sleeved onto the telescopic rod 10 and then the buffer part 40 is mounted and located in the hollow cylinder 33 of the pivotal base 30 with the spherical groove 41 facing outward. One end of the pivotal part 50 with the spherical surface 51 is connected and pivoted to the hollow cylinder 33 of the pivotal base 30 in the direction that the pivotal part 50 can pivot horizontally. Next the two covers 60 on the telescopic rod 10 are moved to a corresponding pivotal base 30. By the inner thread 63 threaded with the outer thread 32, the cover 60 is fixed on the pivotal base 30 for covering the pivotal base 30. And an inner end 511 of the spherical surface 51 is against the spherical groove 41 while an outer end 512 of the spherical surface 51 is against the circularly curved surface 611 around the central opening 61. The curved inner tube 11 and the curved outer tube 12 of the telescopic rod 10 are adjusted according to the relative distance and positions of the two fixing bases 20, and pivoting angle of the pivotal part 50 so as to change the length of the telescopic rod 10. Thus a quick, easy and firm assembling is achieved. At the same time, the product appearance is improved.

Figure 4:
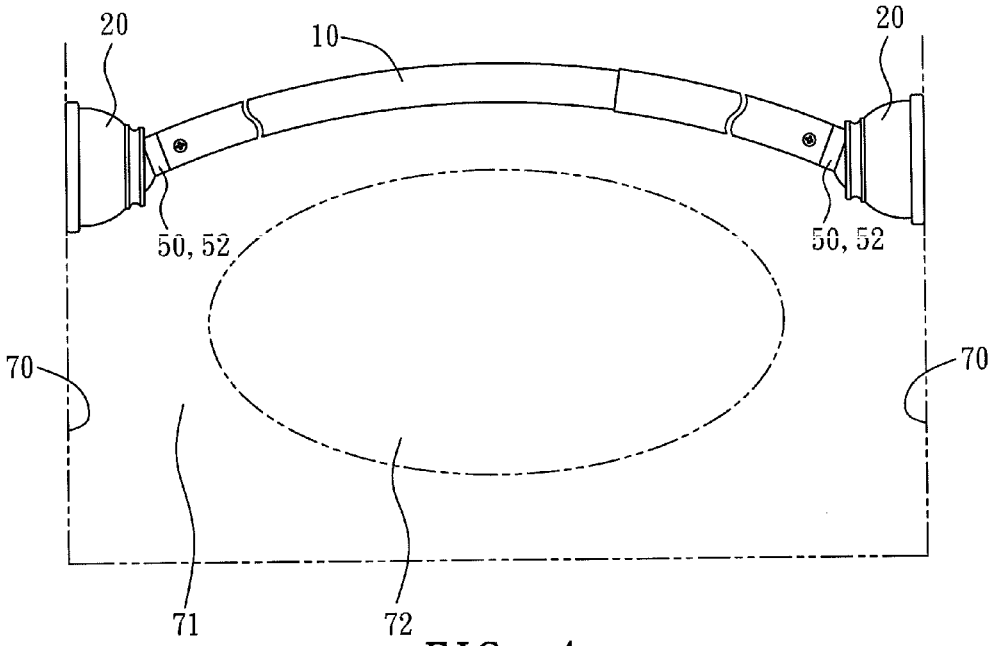
FIG. 4 and FIG. 5 are schematic drawings showing an embodiment of the present invention in use.

Refer to FIG. 4, the figure shows the curved curtain rod 1 of the present invention being applied to two parallel wall surfaces. The two wall surfaces 70 are spaced with a certain interval and arranged in parallel. A space 71 between the two wall surfaces 70 is defined and can be used as, but not limited to, a dressing room. Or the space 71 can be arranged with a bathtub and used as a shower room. The telescopic rod 10 is adjusted to a proper length according to the distance between the two wall surfaces 70 and the pivotal part 50 in the fixing base 20 is pivoted a certain angle so as to make the projecting rod 52 of the pivotal part 50 sleeve and connect with the telescopic rod 10 properly.

Figure 5:
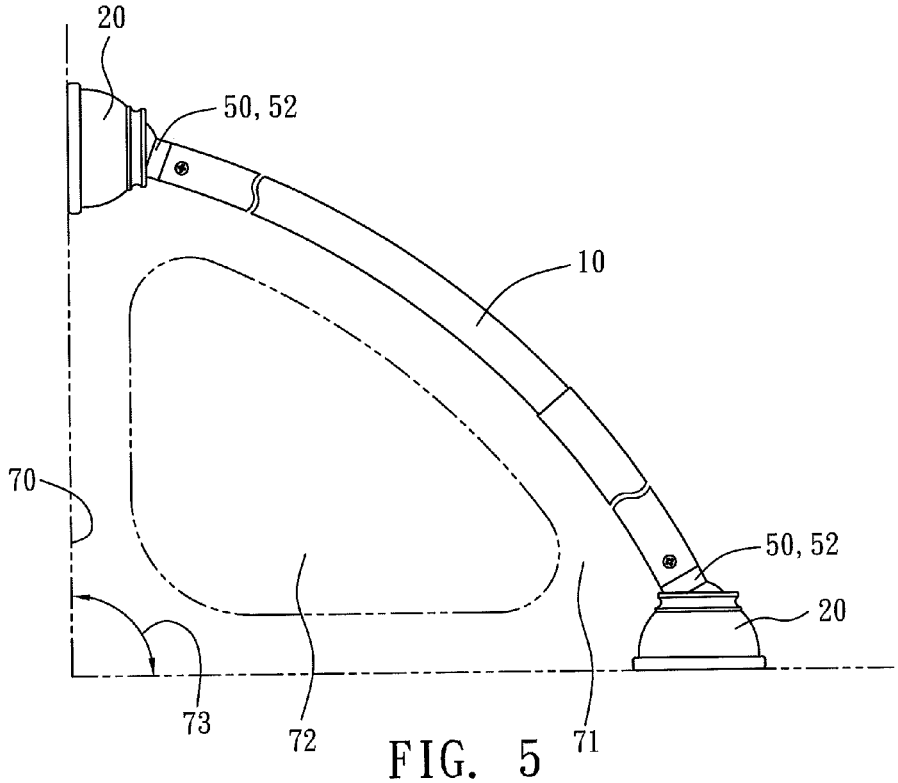

Refer to FIG. 5, the curved curtain rod 1 of the present invention is used between two wall surfaces with an angle therebetween. The connection between the telescopic rod 10 and the fixing base 20 is the same with the embodiment in FIG. 4. Yet the difference is in that there is an angle 73 between the two wall surfaces 70.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A curved curtain rod comprising a curved telescopic rod and two fixing bases; wherein the curved telescopic rod includes a curved inner tube and a curved outer tube, sleeved with each other so as to adjust length of the curved telescopic rod; each of two ends of the curved telescopic rod is connected to each fixing base and is arranged with a radial insertion hole therearound so that the curved telescopic rod is fastened and fixed on the fixing base by a fastener passing through the radial insertion hole;

the fixing base includes a pivotal base, a buffer part, a pivotal part and a cover, wherein the pivotal base having a bottom flange and a hollow cylinder projecting axially from the bottom flange; the bottom flange is disposed with a plurality of through holes so as to be mounted on a wall surface by screws, and is arranged with an outer thread on an outer surface thereof;

the buffer part having a spherical groove on an outer surface thereof is mounted and located in the hollow cylinder of the pivotal base with certain fitness;

one end of the pivotal part is a spherical surface corresponding to and contacting with the spherical groove of the buffer part while the other end thereof is a projecting rod connected to each of two ends of the telescopic rod; the projecting rod is mounted with at least one radial hole and a fastener passes through the insertion hole of the telescopic rod to be fastened on the radial hole so as to fix the telescopic rod between the two fixing bases;

the cover is a bell-shaped cover around the pivotal base and having a central opening whose inner diameter is larger than an outer diameter of the projecting rod of the pivotal part and is smaller than an outer diameter of the spherical surface of the pivotal part so that the pivotal part is limited in an inner side of the central opening while the projecting rod passes through the central opening to the outer side, and moves and pivots; an inner surface on a bottom of the cover is disposed with an inner thread corresponding to the outer thread of the pivotal base so that the cover is fastened and fixed around the pivotal base by the inner thread threaded with the outer thread.

2. The device as claimed in claim 1, wherein an inner surface of the hollow cylinder of the pivotal base includes two symmetrical curved surfaces on left and right sides and two symmetrical planes on top and bottom sides; two parallel planes on top and bottom sides of the spherical surface of the pivotal part are mounted between the two symmetrical planes on top and bottom sides of the hollow cylinder so as to restrict the pivotal part pivoting and moving horizontally inside the pivotal base.

3. The device as claimed in claim 1, wherein an inner surface of the central opening of the cover is a circularly curved surface.

* * * * *